US007640993B2

(12) United States Patent
Head

(10) Patent No.: US 7,640,993 B2
(45) Date of Patent: Jan. 5, 2010

(54) METHOD OF DEPLOYING AND POWERING AN ELECTRICALLY DRIVEN IN A WELL

(75) Inventor: Philip Head, Berkshire (GB)

(73) Assignee: Artificial Lift Company Limited Lion Works, Great Yarmouth, Norfolk (GB)

( * ) Notice: Subject to any disclaimer, the term of this patent is extended or adjusted under 35 U.S.C. 154(b) by 294 days.

(21) Appl. No.: 10/563,855

(22) PCT Filed: Jul. 5, 2004

(86) PCT No.: PCT/GB2004/002941

§ 371 (c)(1),
(2), (4) Date: Jun. 14, 2006

(87) PCT Pub. No.: WO2005/003506

PCT Pub. Date: Jan. 13, 2005

(65) Prior Publication Data

US 2006/0243450 A1 Nov. 2, 2006

(30) Foreign Application Priority Data

Jul. 4, 2003 (GB) ..... 0315666.8
Oct. 3, 2003 (GB) ..... 0323146.1
Apr. 2, 2004 (GB) ..... 0407600.6

(51) Int. Cl.
*E21B 43/16* (2006.01)

(52) U.S. Cl. ..... 166/385; 166/65.1; 166/105

(58) Field of Classification Search ..... 166/385, 166/65.1, 105, 381
See application file for complete search history.

(56) References Cited

U.S. PATENT DOCUMENTS 3,835,929 A 9/1974 Suman ..... 166/384
3,926,269 A * 12/1975 Cullen et al. ..... 175/104
3,939,705 A * 2/1976 Glotin et al. ..... 73/152.51
3,976,347 A * 8/1976 Cooke et al. ..... 439/132
4,150,279 A 4/1979 Metcalfe ..... 219/152
4,494,602 A 1/1985 Capdeboscq ..... 166/66.4
4,589,717 A 5/1986 Pottier ..... 439/277
5,058,683 A * 10/1991 Godfrey et al. ..... 166/381
5,070,940 A 12/1991 Conner ..... 166/65.1
5,180,140 A 1/1993 Araki ..... 251/291
5,191,173 A 3/1993 Sizer ..... 174/105 R
5,355,952 A * 10/1994 Meynier ..... 166/250.01
5,535,828 A 7/1996 derKinderen et al. ..... 166/372
5,740,860 A * 4/1998 Crawford et al. ..... 166/64
5,746,582 A 5/1998 Patterson ..... 418/53
5,871,051 A 2/1999 Mann ..... 166/377
6,668,921 B2 * 12/2003 Koehler et al. ..... 166/242.2
6,684,952 B2 * 2/2004 Brockman et al. ..... 166/250.03
7,063,143 B2 6/2006 Tilton ..... 166/242.6
2002/0050361 A1 * 5/2002 Shaw et al. ..... 166/380
2003/0085815 A1 * 5/2003 Tilton et al. ..... 340/854.4
2004/0055746 A1 * 3/2004 Ross et al. ..... 166/250.15
2004/0094303 A1 * 5/2004 Brockman et al. ..... 166/313
2004/0159444 A1 * 8/2004 Wolters et al. ..... 166/381

* cited by examiner

*Primary Examiner*—Hoang Dang
(74) *Attorney, Agent, or Firm*—Andrew Wilford

(57) ABSTRACT

A system for installing a powered device in a downhole tube has a power line extending down a production tube and terminating in a power connector or contact. The powered device toolstring is down the tube and has a corresponding power connector or contact. The two connectors or contacts are aligned as the connector or contact of the line approaches the connector or contact of the tool. Then the two contacts are fitted together such that they make electrical connection when the powered device toolstring is located adjacent to the power connector or contact of the production tube.

10 Claims, 15 Drawing Sheets

METHOD OF DEPLOYING AND POWERING AN ELECTRICALLY DRIVEN IN A WELL

CROSS REFERENCE TO RELATED APPLICATIONS

This application is the US national phase of PCT application PCT/GB2004/002941 filed 5 Jul. 2004 with a claim to the priority of British patent application 0315666.8 itself filed 4 Jul. 2003, British patent application 0323146.1 itself filed 3 Oct. 2003 and British patent application 0407600.6 itself filed on 2 Apr. 2004.

FIELD OF THE INVENTION

This invention relates to a method of deploying an electrical submersible powered fluid transducer system, such as a gas compressor or an electrical submersible pump, generally known as an ESP, in an oil and/or gas production well.

BACKGROUND OF THE INVENTION

The disposing in wells of electrical submersible systems has been done for many years using jointed tubular conduits with an electrical motor, and a fluid transducer connected to the bottom of the jointed tubing. Consecutive joints of tubular conduits are connected and lowered into a well with the assistance of a rig mast and hoisting equipment, whilst unspooling and connecting to the outer diameter of the tubing a continuous length of electrical power transmission cable. This method of disposing the electrical submersible fluid transducer system is well know to those familiar with the art of producing non-eruptive sources of oil and gas from the subterranean environment. The retrieval of these electrical submersible fluid transducer systems is also commonly accomplished by pulling the jointed tubing out of the well simultaneously with the electrical submersible motor and fluid transducer system and the electrical power transmission cable. The following prior art references are believed to be pertinent to the invention claimed in the present application: U.S. Pat. Nos. 3,939,705; 4,105,279; 4,494,602; 4,589,717; 5,180,140; 5,746,582 and 5,871,051; International patent application No. WO98122692 and European patent specifications Nos. 470576 and 745176. U.S. Pat. Nos. 3,835,929, 5,180,140 and 5,191,173 teach the art of deploying and retrieving an electrical submersible system in oil wells using coiled or continuous tubing. These coiled tubing disposal methods often use large coiled tubing spool diameters owing to the radius of curvature possible of the continuous tubing. Hence the surface spooling devices that these systems require to inject and retrieve the continuous tubing are cumbersome, and require special surface and subterranean equipment for deployment and intervention.

Other previous art disclosed in the literature teaches the disposal and retrieval of the subterranean electrical fluid transducer system with wireline or wire rope as structural support for simultaneously disposing the electrical power transmission cable with the system. Hence these wireline methods and apparatus involve the use of large and unique surface intervention equipment to handle the weight and spool used for the electrical power cable and the wire rope to be run in the well. U.S. Pat. No. 5,746,582 discloses the retrieval of a submersible pumps whilst leaving an electrical motor and cable in a well. Hence the method of U.S. Pat. No. 5,746,582 teaches the retrieval and deployment of the mechanical portion of an electrical submersible fluid transmission system whilst leaving the electrical motor and other component parts of the electrical submersible system disposed in the disposal of the electrical motor separately from the electrical power transmission cable. In the case of artificially lifted wells powered with electrical submersible motor systems, the current art is to dispose the required transducer assembly, for example a pump or compressor assembly, with an electrical motor and electrical power cable simultaneously into the well with a supporting member. This supporting member is jointed tubing from a surface rig, a coiled tubing unit with continues tubing or braided cable. The tubing or a braided cable is required as the electrical power cable is not able to support its own weight in the well and hence must be connected and disposed in the well with a structural member for support. In the case of jointed pipe deployed from a rig, the power cable is attached to the electrical motor on surface, and the cable is attached to the tubing as the electrical motor, transducer, and tubing are disposed into the well casing or tubing. The attachment of the cable to the tube is done by the use of steel bands, cast clamps, and other methods known to those familiar with the oil and gas business. In other methods, the power cable is placed inside of continuous tubing or attached to the outside of continuous tubing with bands as taught by U.S. Pat. No. 5,191,173. This continuous tubing is often referred to in the industry as coiled tubing. U.S. Pat. No. 3,835,929 teaches the use of the continuous tubing with the electrical power transmission cable inside of the tube. In all cases where electrical submersible fluid transducers systems are disposed and retrieved from wells the electric motor and electrical power transmission cable are deployed or retrieved simultaneously.

It is well known to those familiar with electrical submersible power cable that the action of removing the cable from the well can result in damage to the electrical power transmission cable, in a variety of ways. The damage inflicted on the electrical power cable can be due to bending stresses imposed on the cable during the disposal and retrieval. The conventional electrical power cable insulation, wrapping, and shields can develop stress cracks from the spooling of the cable over sheaves and spools devices used to deploy the cable. Another failure mode associated with submersible power transmission cable is caused form impact loads or crushing of the cable as it is disposed or retrieved in the wells. It is also well known that gases found in subterranean environments impregnated the permeability of the electrical power transmission cable's insulation, wrapping and shields.

This gas is trapped in the permeability of the insulation at a pressure similar to the pressure found inside the well. When the cable is retrieved from the well the electrically powered transmission cable is exposed to ambient pressures. This will create a pressure differential between gas encapsulated in the cable insulation and the ambient surface pressure conditions. The rate of impregnated gas expansion from the higher pressure inside of the cable insulation expanding towards the lower pressure of the ambient conditions can sometimes exceed the cable insulation permeability's ability to equalise the pressure differential. The result is a void, or stressing of the insulation, and premature failure of the cable. The requirement to retrieve and dispose the electrical power transmission cable with the electrical submersible fluid traducer system also requires the use of specialised surface intervention equipment. This can require very large rigs, capable of pulling tubing, electrical power transmission cable, and electrical submersible fluid transducers. In the offshore environment these well intervention methods require semi-submersible drill ships and platforms. In the case of jointed conduit deployed in a plurality of threaded lengths, normally 9-12 m each, the pulling equipment is a drilling or pulling rig at surface. In the case that the electrical power transmission cable and assembly are disposed connected to or in continuous tubing, a specialised coiled tubing rig is required at surface. This coiled tubing unit consisting of an injector head, a hydraulic power unit, and a large diameter spooling device containing the continuous coiled tubing all located on the surface. This disposal and retrieval method requires significant space at the earth's surface or sea floor. The reasons for intervening in a well to retrieve or dispose an electrical submersible transducer system are well know to those familiar with the art of fluid removing fluids from wells. There are at least two classical reasons for intervention in wells disposed with electrical submersible fluid transducer systems. These include the need to increase fluid production, or the need to repair the disposed electrical submersible power system. The reason for requiring increased fluid production is dependent on many factors including but not limited to economical and reservoir management techniques discussed in the literature. The reasons for intervening for repair or to replace the electrical submersible fluid transducer systems are due to normal equipment wear and the subsequent loss of fluid production capacity, catastrophic equipment failure, and changes in the fluid production capacity of the subterranean fluid reservoir. The equipment failures can be caused due to subterranean electrical failures in the electrical motor windings, electrical motor insulation degradation due to heat or mechanical wear, conductive fluid leaking into the motor, wear or failure of the fluid transducer parts, wear of electrical motor bearings, shaft vibrations, changes in inflow performance of the reservoir, and other phenomena known to those familiar with the art of fluid production from wells. Therefore, it is often required to change out component parts of the electrical submersible fluid transducer system, but not necessarily the electrical power transmission cable. However, owing to prior art the power cable is retrieved when the electrical motor or the motor seals fail.

SUMMARY OF THE INVENTION

According to the present invention, there is provided a system for installing a powered device in a downhole tube, comprising a power line disposed along a production tube, terminating in a first power connector, an orientation means disposed in the vicinity of the first power connector, and a powered device including a second power connector, the powered device being lowered down the production tube and oriented by the orientation means so that the first power connector means and second power connector means engage to connect the powered device to the power line.

Preferably the first power connector is supported by an alignment means that moves the first power connector from a first unaligned position to a second aligned position as the power connector descends towards it so that the first power connector means and second power connector means engage to connect the powered device to the power line.

According to another aspect of the present invention, there is provided a system for installing a powered device in a downhole tube, comprising a power line disposed along a production tube, terminating in a first power connector, the powered device being lowered down the production tube, the first power connector being supported by an alignment means that moves the first power connector from a first unaligned position to a second aligned position as the power connector descends towards it so that the first power connector means and second power connector means engage to connect the powered device to the power line.

The aligned position may be closer to the centre of the bore than the unaligned position.

Preferably a sleeve is provided with a cammed surface of which is shaped to orient the powered device. The sleeve ideally includes a keyway to move the first connection means towards the centre of the bore.

The method according to the invention comprises: connecting an electrical power cable to a first part of a wet mateable electrical power connector which is secured to a lower region of a production tubing; lowering the production tubing and the electrical power cable into the well; lowering through the production tubing an electrically driven downhole fluid transducer system which is equipped with a second part of a wet mateable electrical power connector; releasably latching the transducer system to the production tubing such that the two parts of the wet mateable power connector face each other; Lowering of the electrical submersible fluid transducer system would be any number of means the most practical being a slickline or wireline conveyed system. If the device is in a deviated well then an electrically powered tractor could be used.

In addition, it is extremely important to maximize the internal diameter of the tubing to allow the largest sized motor and pump to be conveyed internally. Consequently, a novel packer arrangement is ideally employed which accommodates electrical feed-throughs, and which is mechanical expanded using a mechanical roller system. This eliminates all the complicated components of a traditional packer device while achieving all the required functions of a packer device. i.e. a pressure bulk head and tubing anchoring means. Finally to remove the expanded packer, an internal support may be lowered and installed, which traverses the expanded section. A suitable acid may then be pumped into the tubing which dissolves the expanded section, allowing the quick and simple recovery of the tubing.

The current invention is an improvement to the known art of well construction, this invention teaches operational methods and claims apparatus related to disposing, operating, and retrieving electrical submersible fluid transducers systems. More particularly, the invention's methods and apparatus enables the electrical power transmission cable to remain in the well whilst teaching a plurality of retrieving and/or disposing well interventions for components of the electrical submersible fluid transmission system.

According to another aspect of the present invention there is provided a system for removing liquid from a portion of a borehole, comprising a motor;

a pump;

a tube disposed within the borehole so as to define an annulus between the outer surface of the tube and the wall of the borehole a packer sealedly separating the annulus above the packer from the lower part of the borehole, such that gas may be produced up the bore of the tube, and liquid may be pumped into the annulus above the packer.

Preferably the motor and pump may be moved along the tube.

According to another aspect of the present invention there is provided a system for removing liquid from a portion of a borehole, comprising a tube disposed within the borehole so as to define an annulus between the outer surface of the tube and the wall of the borehole and a sump packer sealing the sump of the borehole with the borehole above it such that a motor and pump may be used to direct liquid in the borehole either up the annulus, or below the sump packer.

According to another aspect of the present invention there is provided a system for removing liquid from a portion of a borehole, comprising a motor;

a pump;

a sump packer sealing the sump of the borehole with the borehole above it the inlet of the pump being in fluid communication with the borehole above the sump packer, and the outlet of the pump being in fluid communication with the borehole beneath the packer.

According to yet another aspect of the present invention, there is provided a system for installing a powered device in a downhole tube, comprising a power line disposed along a production tube, terminating in a at least power connector or contact, and a powered device toolstring which may be lowered down the tube, the powered device having a corresponding power connector or contact, the two contacts making electrical connection when the powered device toolstring is located adjacent to the power connector or contact of the production tube.

Preferably at least one of the power connectors or contacts are annular.

Preferably a protective element is locatable adjacent to the power connector or contact of the production tube, the protective element being displaceable by the powered device toolstring to reveal the power connector or contact of the production tube.

DETAILED DESCRIPTION

Figure 1:
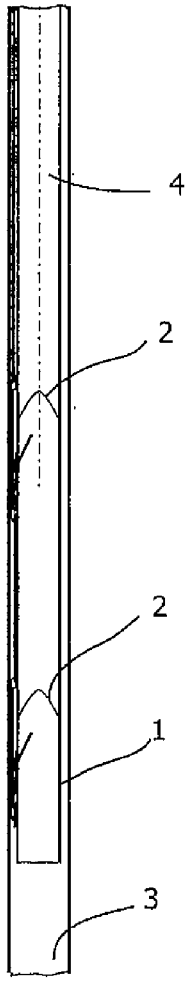
FIG. 1 illustrates how the production tubing, electrical power cable, side pocket electrical connection are installed permanently in an oil or gas well.
Figure 2:
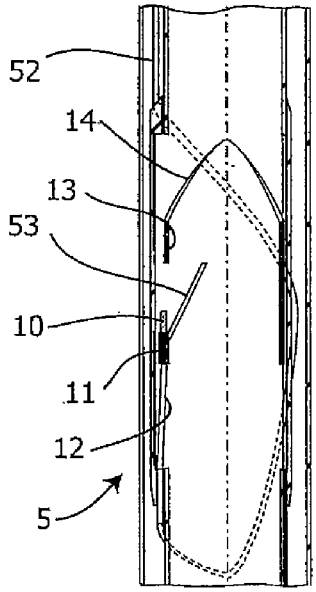
FIG. 2 shows a side view of the electrical side pocket, with the electrical wet connect in the retracted mode.

FIG. 1 shows production tubing 1, with two side pocket electrical connection housings 2 located in it. Oil flows from a lower zone 3, via the tubing to surface 4.

FIGS. 2-5 show the side pocket electrical connection tool in more detail, In the example shown, it consists of 3 wet electrical connections 10 housed in such a way as not to obstruct the main bore when not in use. Provision of three connectors allows power to be supplied in convenient three-phase form. The electrical wet connects 10 are mounted on a saddle 11. The saddle includes lugs which engage a keyway mechanism 53 built into a sliding sleeve 13. The sleeve will ideally include an internal surface shaped to accommodate the saddle at its most radially outward position and allow it to move as described below without interference. The lugs on the saddle may be shaped to keep the wet connects upright.

Suitable power cabling 52 is disposed in the annulus between the borehole and the production tubing, secured to the outer surface of the production tubing. This cabling enters the side pocket unit through a port 56 before being separated into three connection cables 12. On the upper surface of the sliding sleeve is a orientation profile 14 which is shaped to ensure the component docking into it is oriented at the correct angle. Only after the docking component is correctly orientated will the saddle 11 be moved into the main bore.

FIG. 6-9 show the sequence of operation when the through tubing deployed electrical device reaches the side pocket electrical connection.

Figure 3:
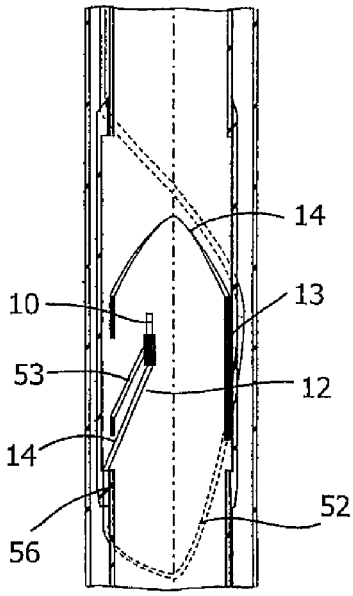
FIG. 3 shows a side view of the electrical side pocket, with the electrical wet connect in the deployed mode.
Figure 4:
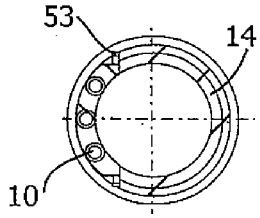
FIG. 4 shows a plan view of the electrical side pocket, with the electrical wet connect in the retracted mode.
Figure 5:
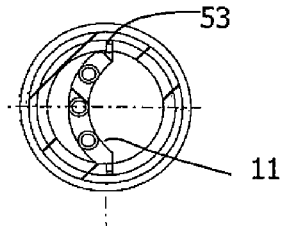
FIG. 5 shows a plan view of the electrical side pocket, with the electrical wet connect in the deployed mode.
Figure 6:
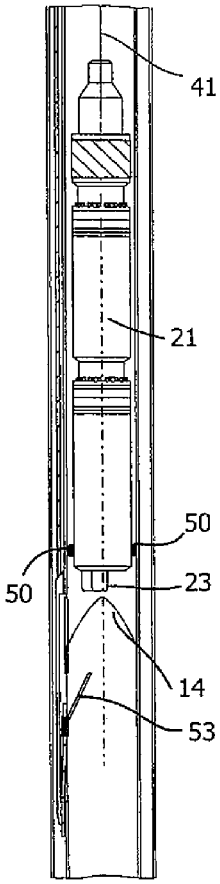
FIG. 6 shows a side view of the well, with a pump being deployed inside the tubing and engaging a locating profile built into the side pocket electrical connect
Figure 7:
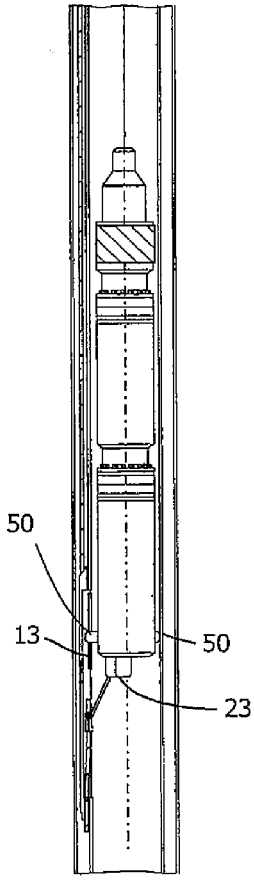
FIG. 7 shows a side view of the well, with a pump being deployed inside the tubing and engaged and orientated into a locating profile built into the side pocket electrical connect
Figure 8:
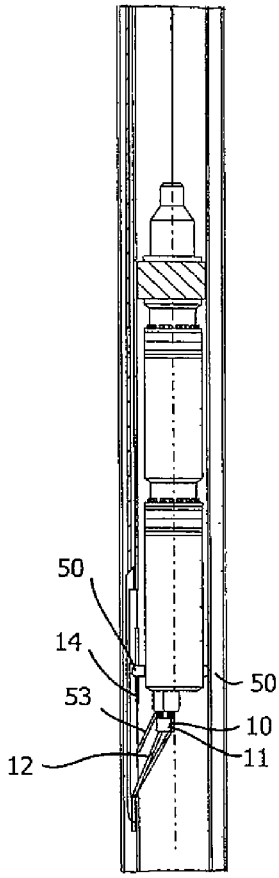
FIG. 8 shows a side view of the well, with a pump being deployed inside the tubing and sliding a sleeve to deploy the electrical wet connects built into the side pocket electrical connect
Figure 9:
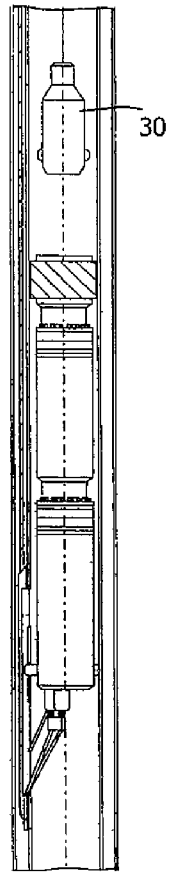
FIG. 9 shows a side view of the well, with a pump being deployed inside the tubing and landed with the electrical wet connects mated and the slick line deployment system disengaged.

The device 21 being deployed is lowered through the production tubing on a wireline 41. As the deployed device contacts the sleeve, extendible dogs 50 in the lowermost part of the deployed tool locate on the profile 14 and orient the assembly 21 to the required angle as the deployed device is lowered. As shown in FIG. 7, once oriented, the dogs push the sliding sleeve downwards. The male electrical wet connects 10 are both constrained in the keyway 53 whilst also being held approximately level with respect to the side pocket and production tubing, for example by including an cables 12 which are sufficiently stiff. The keyway is at an angle to the axis of the production tubing, so that as the sleeve descends relative to the production tubing, the male electrical wet connects are constrained to move towards the centre of the main bore (as illustrated in FIGS. 3 and 5), so that male electrical wet connects 10 are aligned with the female half 23 of the wet connect provided on the deployed device. In its fully landed position 25 the wet electrical connections 10, 23 are fully engaged and the load of the deployed system is fully supported by the landing sleeve. At this time the deployment system 30 can be disengaged and recovered to surface as shown in FIG. 9.

One example of a deployed device which could suitably be installed in this way is a pump. After the male wet connects 10 and the female wet connects 23 are engaged, the pump can be turned on and fluid pumped to surface. It will be realised though that other assemblies requiring power can be installed using the principles disclosed herein.

In the above embodiment, the deployed device is provided with two dogs 50 which follow the upper surface of the sleeve as the pump descends, orienting the pump. It will be realised that other equivalent configurations are possible, such as providing the device with a single dog, and using a sleeve whose upper surface has a helically descending surface subtending 360°, the top and bottom of the helix being joined by a vertical step. The shaped orienting surface could be included on the bottom of the device.

Should the deployed device only be required temporarily, the deployment process may be reversed. The sleeve may include some resilient member, such as a spring, so that the sleeve is maintained in its uppermost position, and the male wet connectors 10 retained away from the centre of the bore, when no powered device is installed. The principles included herein could alternative or additionally supply hydraulic power.

Figure 10:
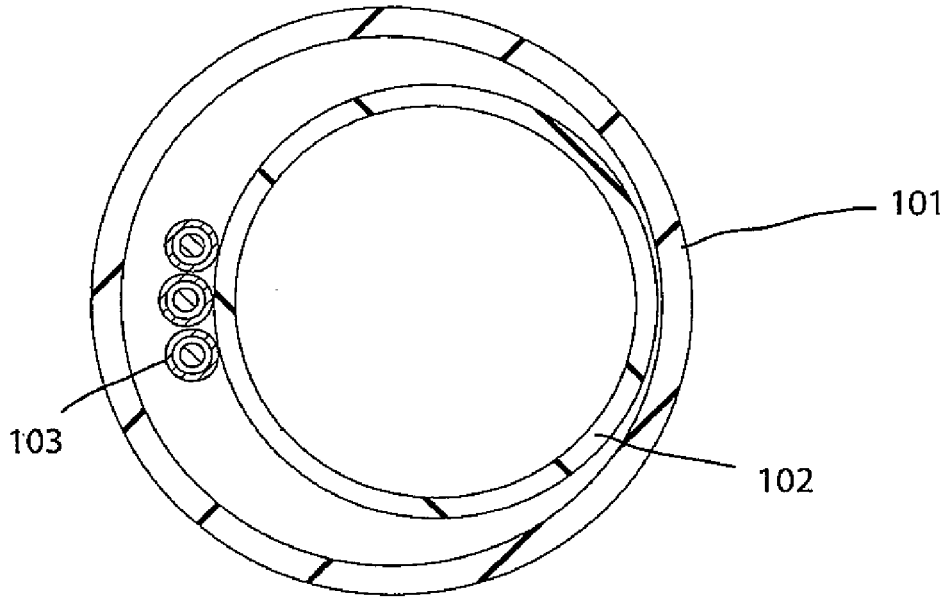
FIG. 10 shows a cross section of the well

FIG. 10 shows the casing of a well 101, in which a flush jointed tubing is installed 102 and externally strapped to the outside of the tubing is a power cable 103.

Figure 11:
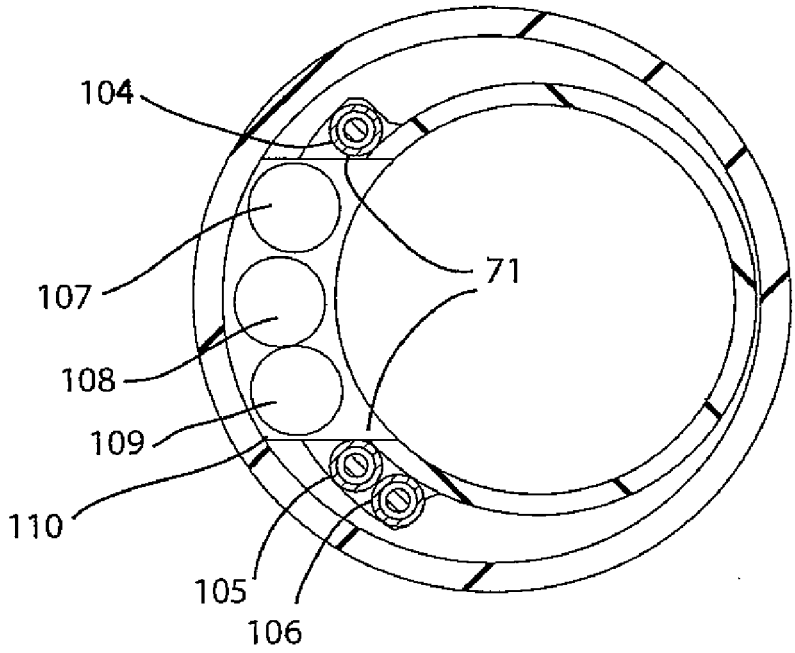
FIG. 11 shows a cross section of a side pocket electrical wet connect device.
Figure 12:
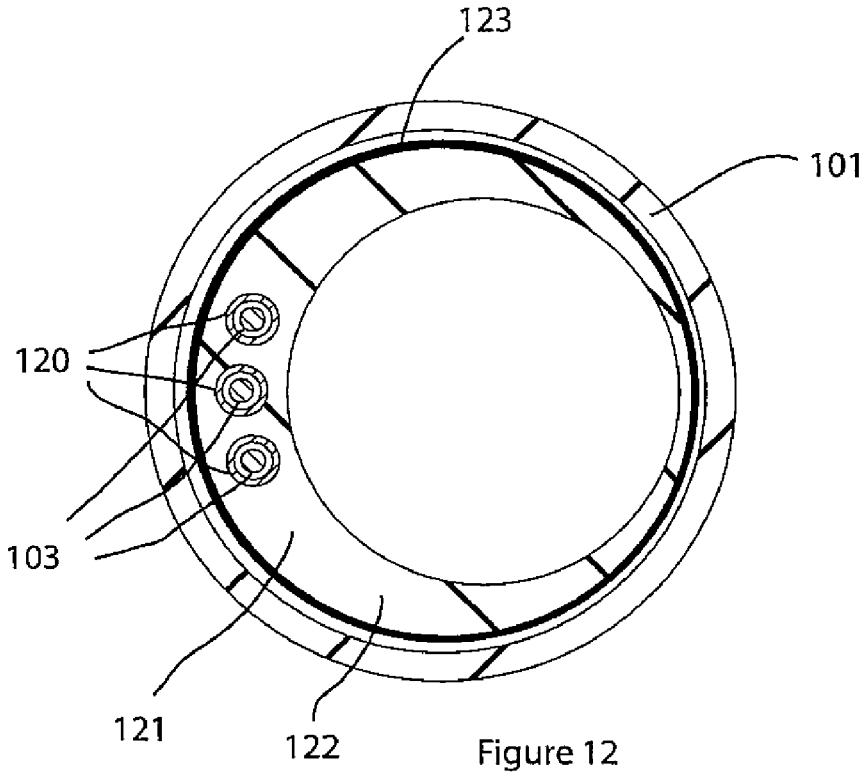
FIG. 12 shows a cross section of an expanding packer with three electrical feed throughs, unexpanded
Figure 13:
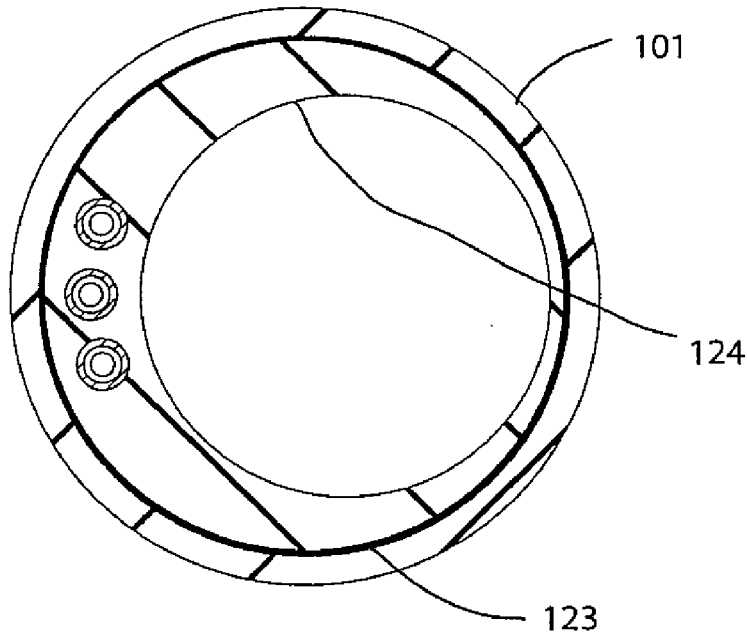
FIG. 13 shows a cross section of an expanding packer with three electrical feed throughs, expanded

FIG. 11 shows the cross section at the side pocket wet electrical wet connect. The electrical cables 103, if they are metal clad, are fed into guide tubes 104, 105, 106, these both ensure the electrical wires follow a set path and are protected at this location. The guide tubes are part of the saddle 110 which holds the wet electrical connect assembly 107, 108, 109. The saddle is a pressure vessel and internally, the wires are connected to the lowermost end of the connectors 107, 108, 109.

Figure 14:
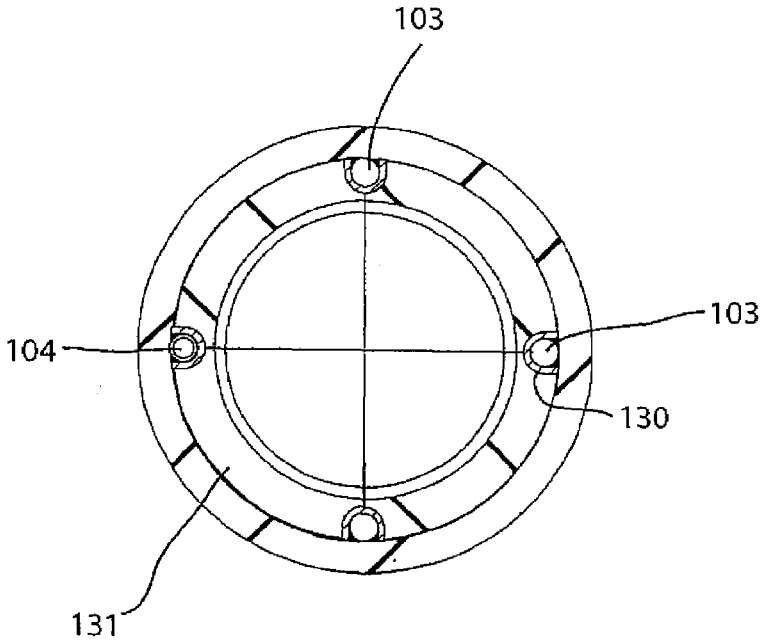
FIG. 14 shows a cross section of another embodiment of an expanding packer with feed throughs expanded
Figure 15:
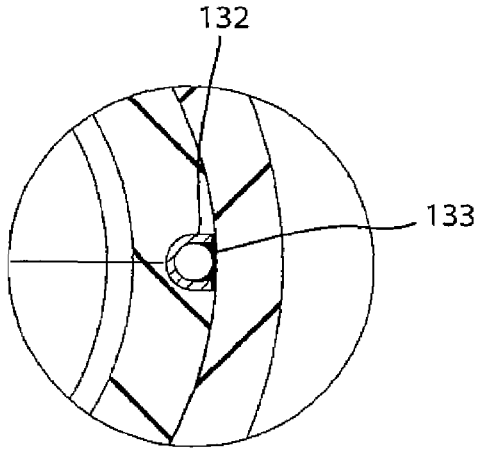
FIG. 15 shows an electrical feed through detail of FIG. 5
Figure 16A:
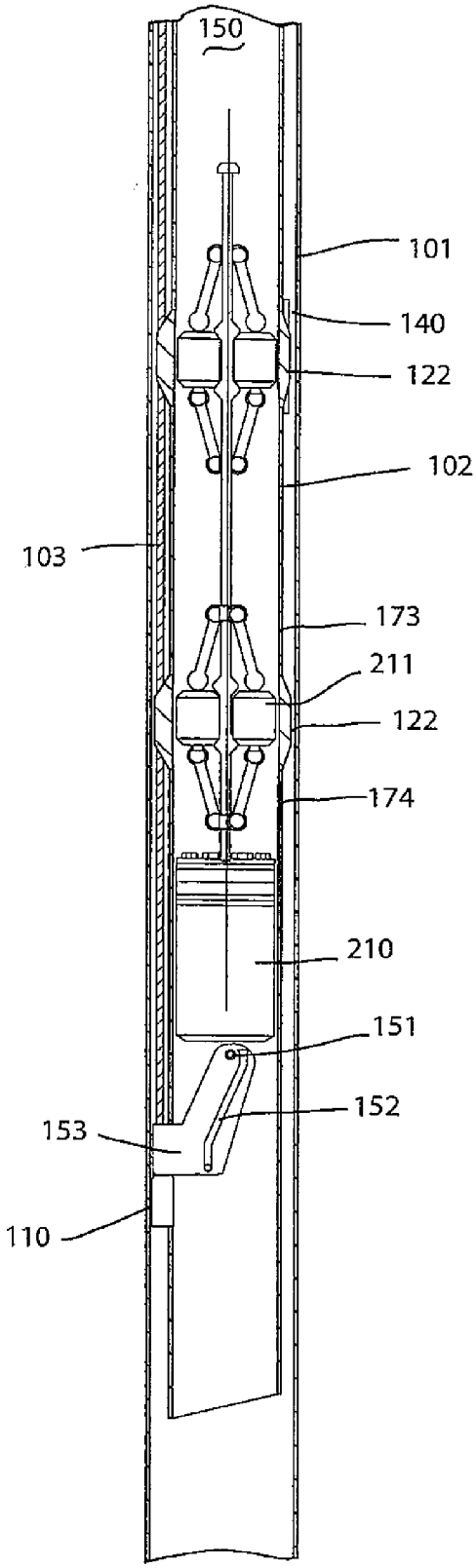
FIG. 16A shows a side view of a well with the completion installed and an electrically powered expanding tool adjacent to each expandable packer
Figure 16B:
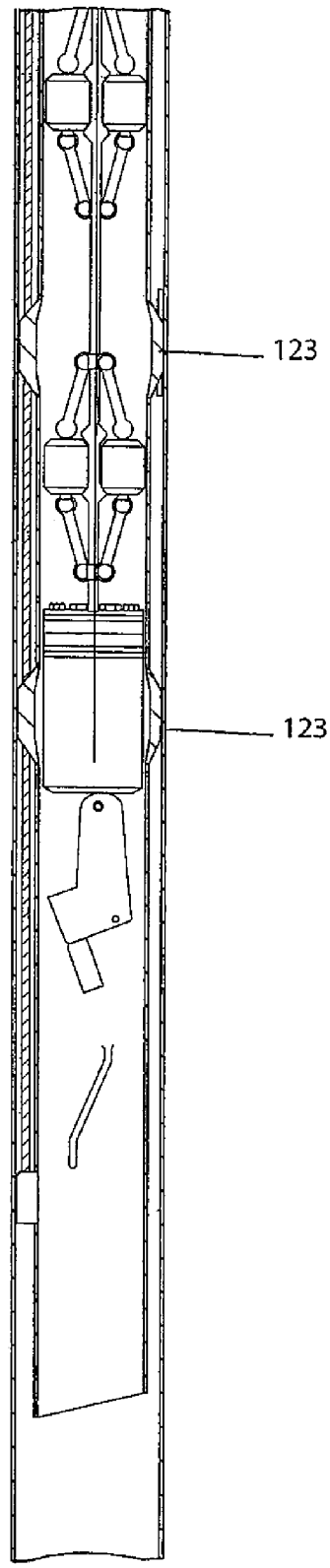
FIG. 16B shows a side view of the well with the two expandable packers expanded and the electrically powered roller expander being recovered back to surface.

FIG. 12 to 15 shows an expanding packer with electrical feedthru's, The metal clad electrical cables 103 are installed inside tubes 120 in the eccentric wall 121 of the packer 122, the outer surface of the packer is coated in elastomer 123 for a pressure seal. When the inner surface 124 is expanded, it forces the rubber element 123 into intimate contact with the casing 100. This is both a pressure tight seal and provides tensile capacity. The tubes 120 protect the electrical cables 103 from excessive compression forces. There are O rings around the cables 103 not shown. If the packer is some way along the tubing 102, it would be very difficult or impossible to feed the cables 103 through individual holes. Referring to FIG. 14, in this situation slots 130 are machined into the packer body 131 so that the cables do not need to be cut but can be laid into the slot and held in place with suitable retaining means not shown. Four such slots 130 may be formed around the tube's circumference, three housing the cables 103, and one housing a check valve insert 134 for venting gas. Referring to FIG. 15, a high-strength protective cap 132 maybe used to prevent the metal clad cable being subjected to excessive compressive load when the packer body 131 is expanded. A small amount of elastomer or soft metal 133 may fill the void along the cable. When it is energized, it fills all the gaps and prevents fluids and gases migrating along the cable.

FIGS. 16 to 21 show the well casing 101 with production tubing 102 and packers 122. A power cable 103 is deployed on the outside of the tubing 102 terminating with a side pocket wet connect 110. Apertures 173, 174 have been cut in the tube, ideally prior to installation. In one of the packers a vent check valve 140 is located. Full bore 150 access to the well is possible for serving the perforations or sections of the reservoir.

Figure 17:
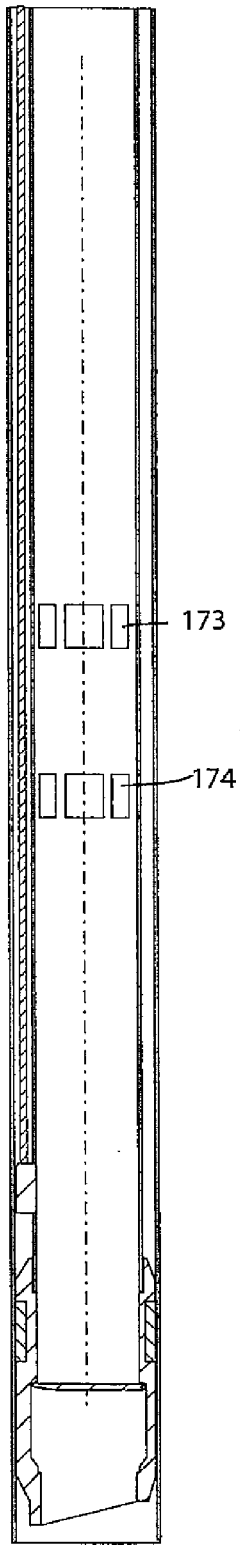
FIG. 17 shows a side view of the well, with landing positions for a wet connect device, and deep set sub surface safety valve and a side pocket electrical connection.
Figure 18:
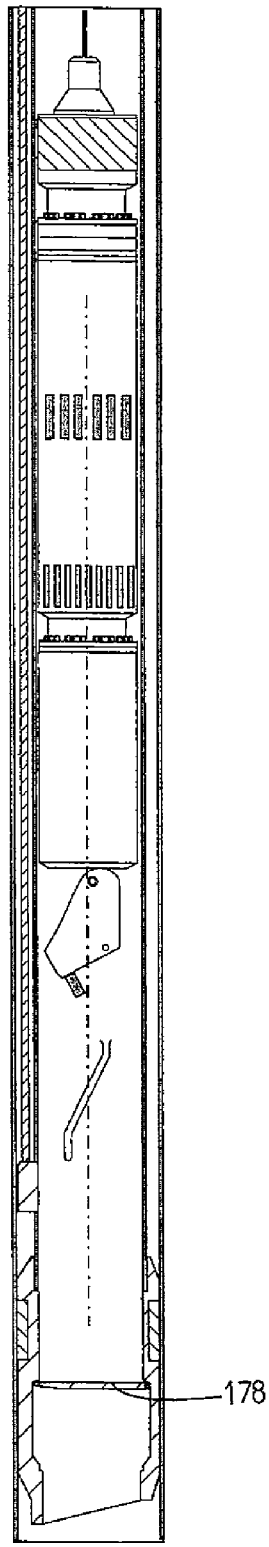
FIG. 18 shows a side view of the well, with a pump being deployed inside the tubing and engaged and orientated into a locating profile built into the side pocket electrical connect
Figure 19:
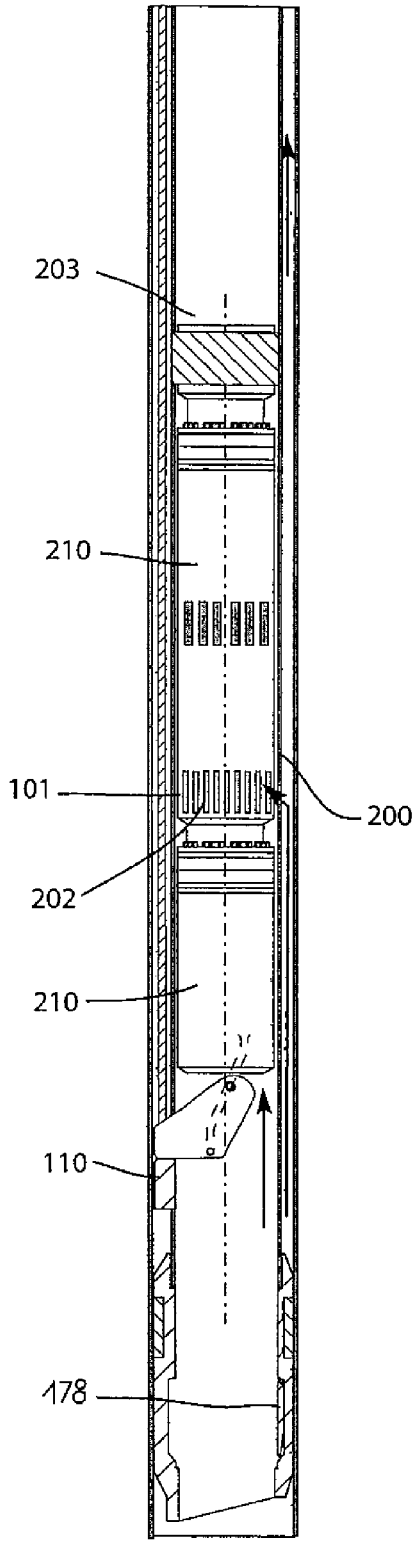
FIG. 19 shows a side view of the well, with a pump being deployed inside the tubing and the docking support both activating the conveyed electrical wet connect and providing the support for the entire weight of the deployed pumping device
Figure 20:
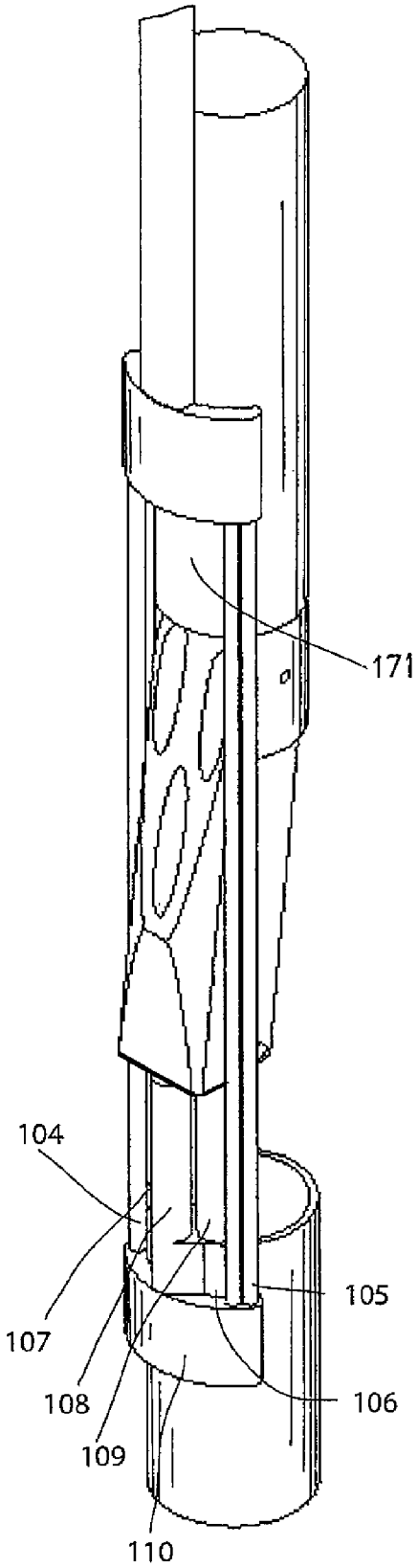
FIG. 20 shows an isometric picture of the docking port, as it is installed in the tubing; with a side pocket wet connect engaged
Figure 21:
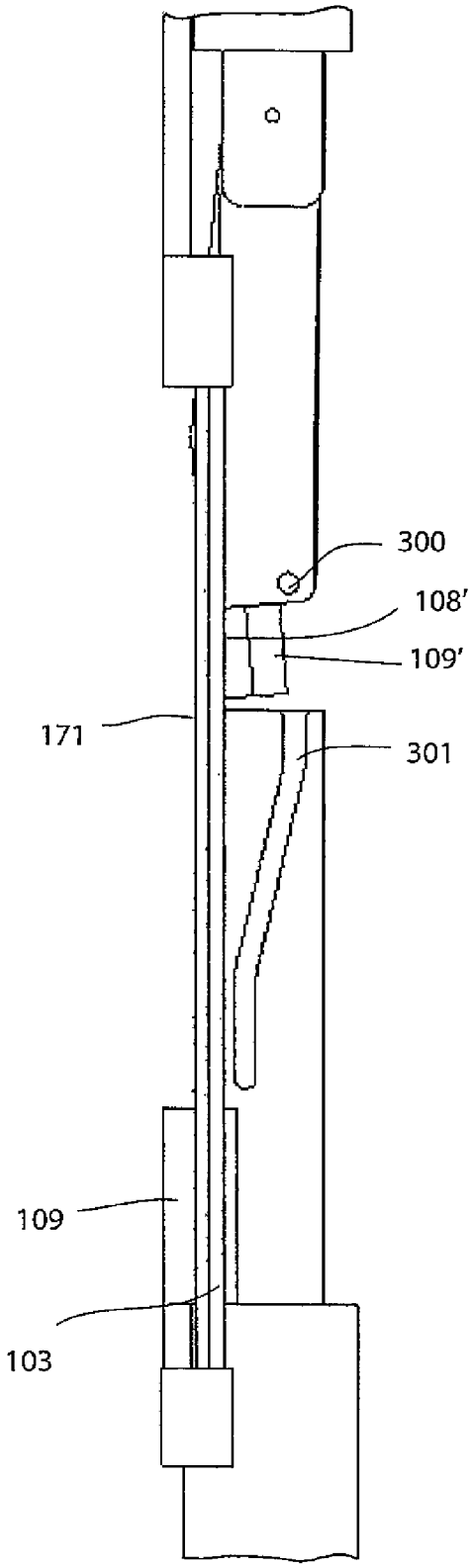
FIG. 21 shows a side view of the side pocket wet connect
Figure 22:
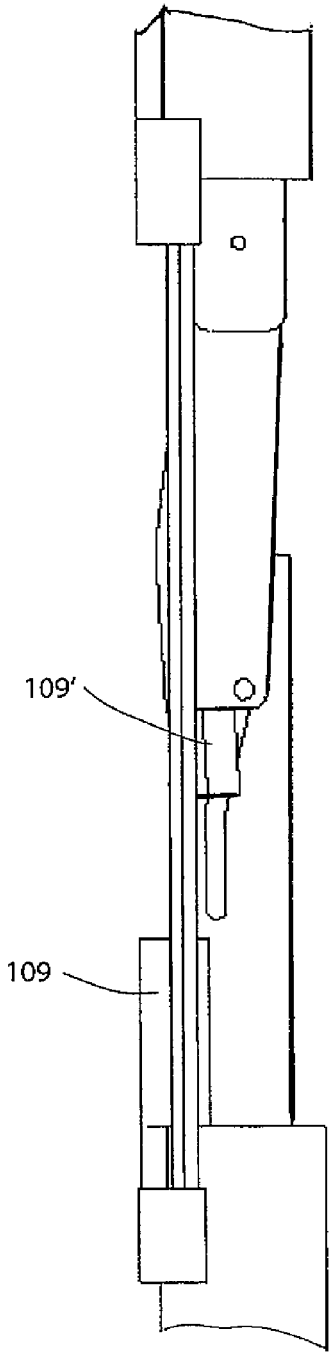
FIG. 22 shows a side view of the side pocket wet connect with the internally conveyed tool with lugs engaged in the kick over and orientation key way
Figure 23:
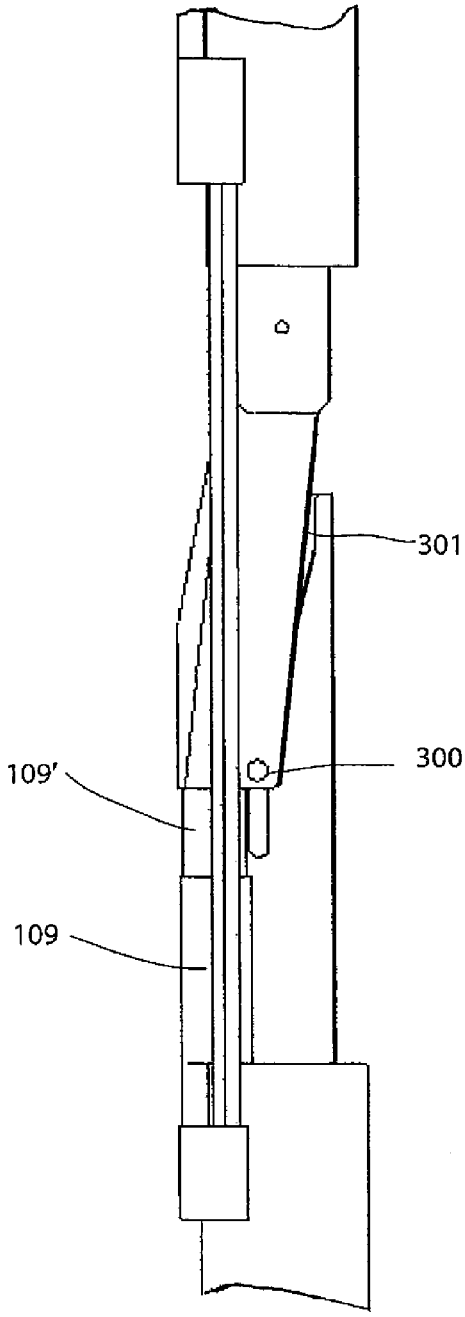
FIG. 23 shows the side pocket wet connect of FIG. 22 later in the engagement process
Figure 24:
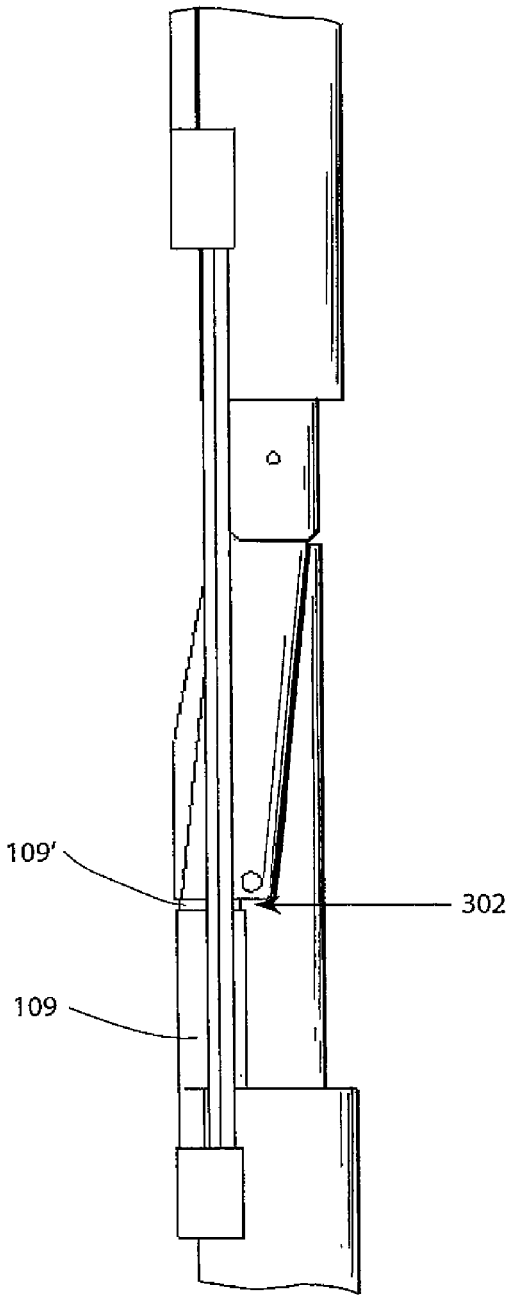
FIG. 24 shows a side view of the side pocket wet connect with the internally conveyed tool fully engaged and in the position to transmit electrical power.

During the initial tubing installation an electric motor 210 with roller expanding devices 211 is located at packers 122. When set to the required depth, and hung off at surface, the electric motor 210 is energized from surface through the side pocket electrical connection 110, this in turn rotates the expandable rollers 211 which mechanically expand the metal packer 122 to come into intimate contact with the casing into its set position 123. Once this operation has been completed the electrically powered expander is recovered to surface using a slick line recover system (not shown) to leave the bore with packers 123 expanded, as shown in FIG. 17. A docking support (not shown) could be left in the tubing, and the weight of the wet connect assembly supported on this. If however the tubing was left full bore, when it is required to deploy a device to be set at the side pocket electrical wet connect, a slick line deployed docking support could lowered into the well and located at the required depth by a set of corresponding recesses in the tubing 102. The pump assembly is then lowered into the well. It is orientated by a single 360 degree groove cut into the tubing 102 (not shown) so that the assembly is orientated correctly to the side pocket 110. An arbour 153 on the lower end of the motor assembly hinges radially outwards as actuating lug 151 engages with cammed surface 152. The electrical wet connection is made and completed as the assembly comes to rest against the wet protect 110 (or a separate docking support if necessary). At the final rest position, it can be seen that the well fluids can flow annularly 200 into the pump inlet 101 through slots 202 in the production tubing 102. When the pump is energised fluid is discharged from the pump outlet 203 into the production tubing ID. If gas is separated from the pump, it needs to be separated to prevent the centrifugal pump from "gas locking" up. In this case a gas separator can be fitted, and its outlet can discharge into the chamber 210 this is vented into the tubing annulus via the check valve 140. A sub-surface safety valve 178 may be included in the installed assembly.

FIG. 20 to 24 show the side pocket electrical wet connect in more detail. A window is cut 171 in the tubing. Externally a saddle is made which holds wet electrical connects 170 and has metal tubes 104,105 and 106 which provide safe passage for the electrical cables past the window and allow the electrical connections to be made inside the saddle. On the lower end of the tool deployed on wireline are lugs 300 which have been orientated in the manner previously described to align with keyways 301 suitably positioned relative to the window 171. As the lugs engage the keyway, they are guided by its profile which cause the electrical wet connections 107', 108', 109' to become oriented to those in the side pocket window 107, 108 and 109. The assembly is not fully landed, but a small clearance is left 302 so that the wet connects never have side loading or compressive force applied to them. In this side pocket wet connect embodiment no structure in the inner bore is required to make the kick over operation occur. To disengage the reverse operation is performed.

Figure 25:
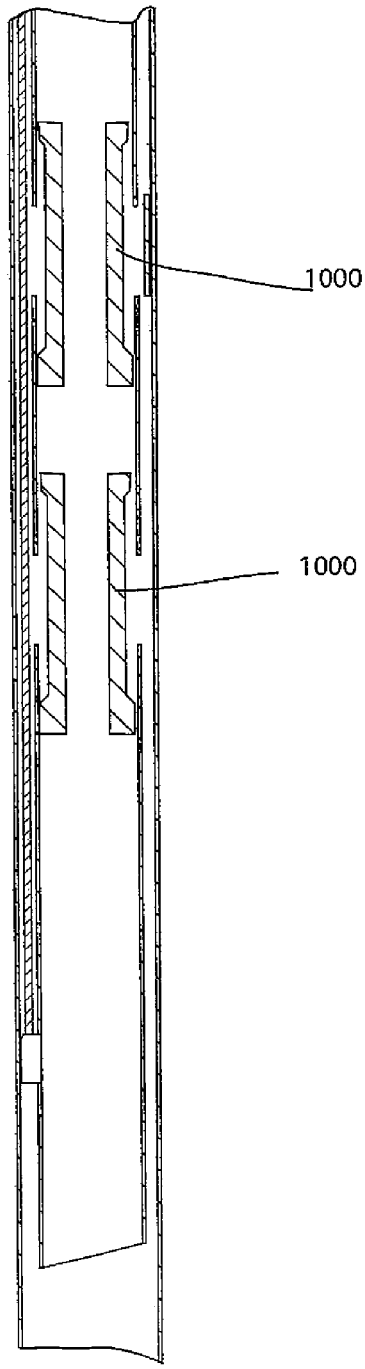
FIG. 25 shows a side view of the assembly during a recovery stage.
Figure 26:
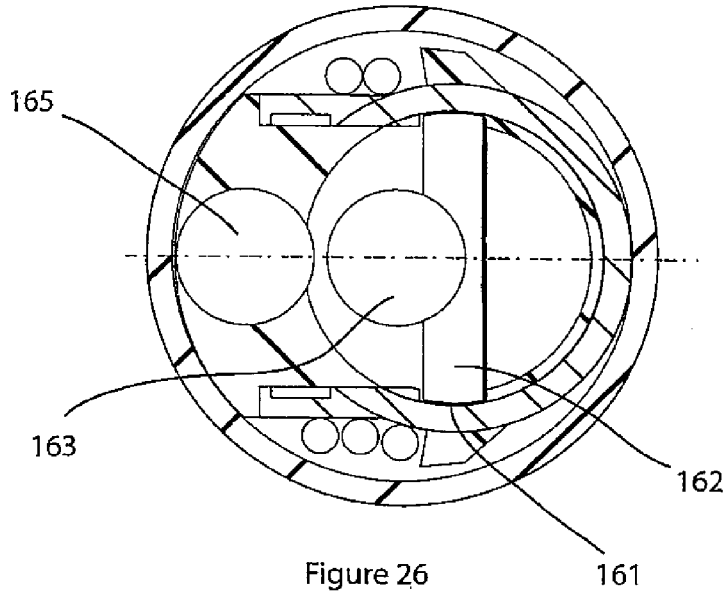
FIG. 26 shows a plan view of another embodiment of the electrical side pocket, with the deployed half located in the well bore, prior to engagement
Figure 27:
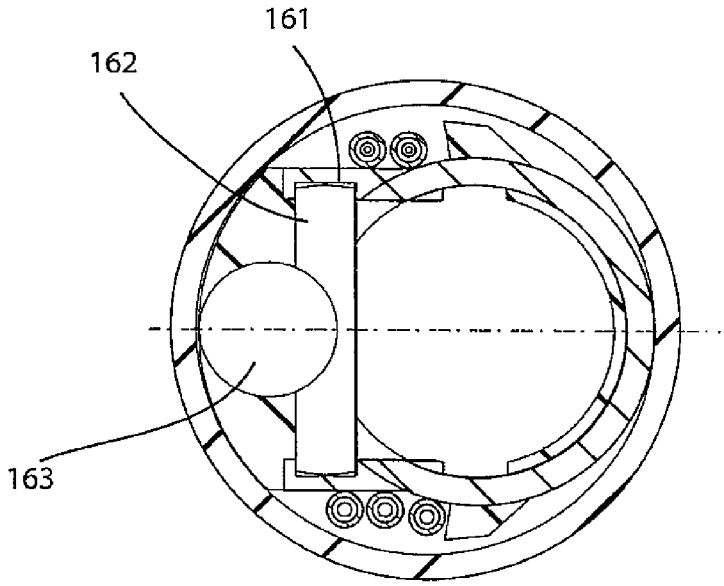
FIG. 27 shows a similar view to FIG. 26 with the two halves of the electrical wet connect fully engaged in the side pocket assembly
Figure 28:
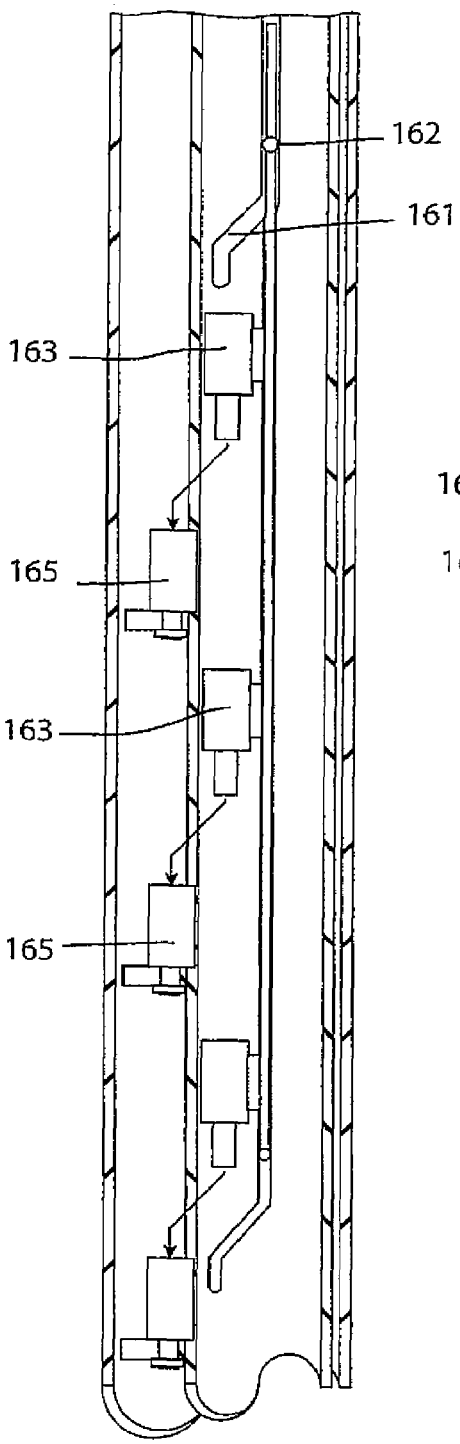
FIG. 28 shows a side view of the FIG. 26 embodiment, with the required number of electrical wet connects stacked on top of each other, and located in the wellbore prior to engagement
Figure 29:
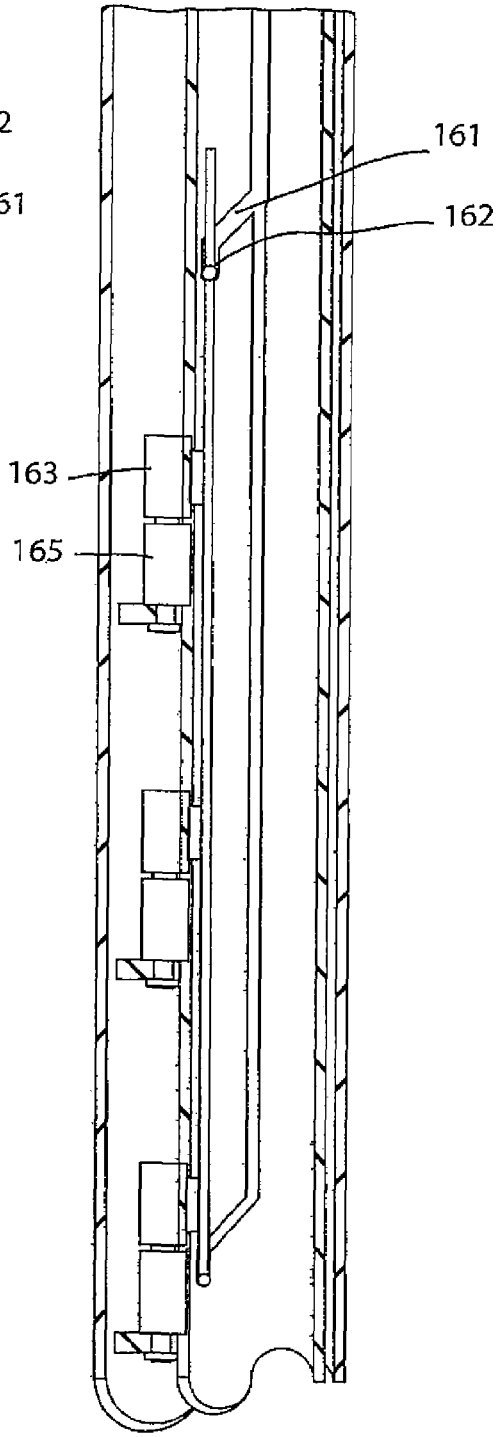
FIG. 29 shows a similar view to FIG. 28, with the electrical wet connects fully engaged in the side pocket assembly.

FIG. 25 shows the recovery of the tubing in the event the well needs to be abandoned. The expanded sections could be machined out, or alternatively, if the body of the expanded section was titanium (for example), internal support tubes 1000 could be placed into the tubing, then the titanium tube exposed to hydrofluoric acid, so that very rapidly the titanium tube dissolves and the tubing would be free to recover to surface.

FIG. 26 to 29 show a further embodiment of the side pocket connection system, in this version it maybe be necessary to use a large wet connect assembly, or it may be necessary to connect several assemblies and these may occupy more space than that available to make multi connections on a single plane. Hence a stacking arrangement such as that shown in FIGS. 28 and 29, using a suitable keyway and cam profile 161, can be used so that a lug 162 pushes the assembly over into the side pocket once correctly aligned so that the assemblies multiple wet connector 163 contact corresponding wet connectors 165 installed in the tube.

Figure 30:
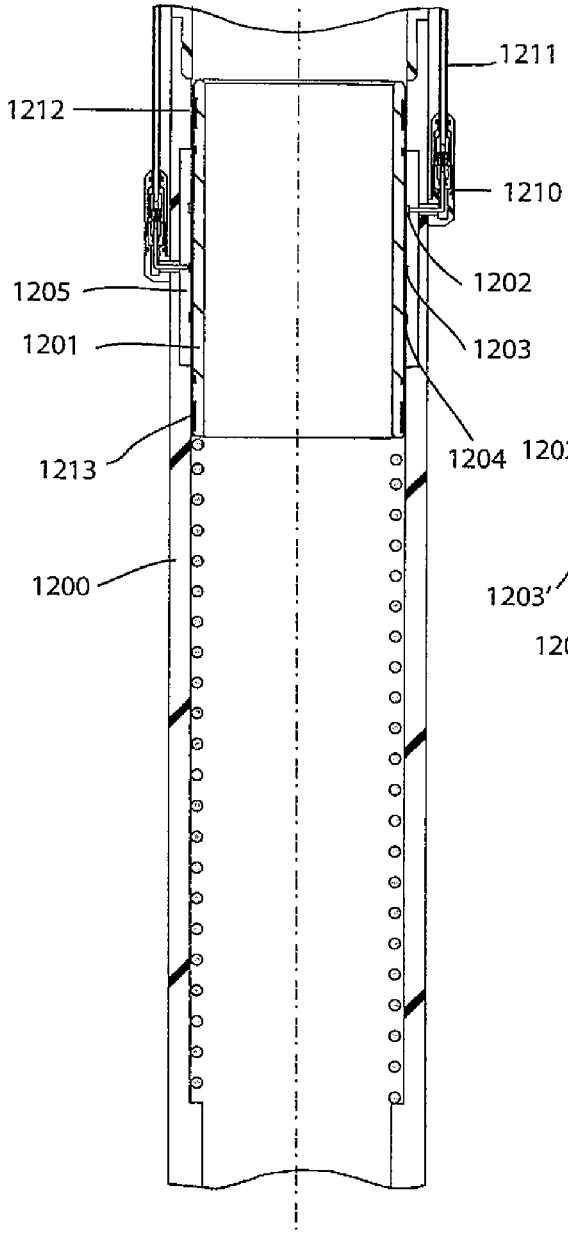
FIG. 30 shows a side view of a further embodiment of a downhole wet connect assembly, using the full annular area of the pipe to make electrical contact.
Figure 31:
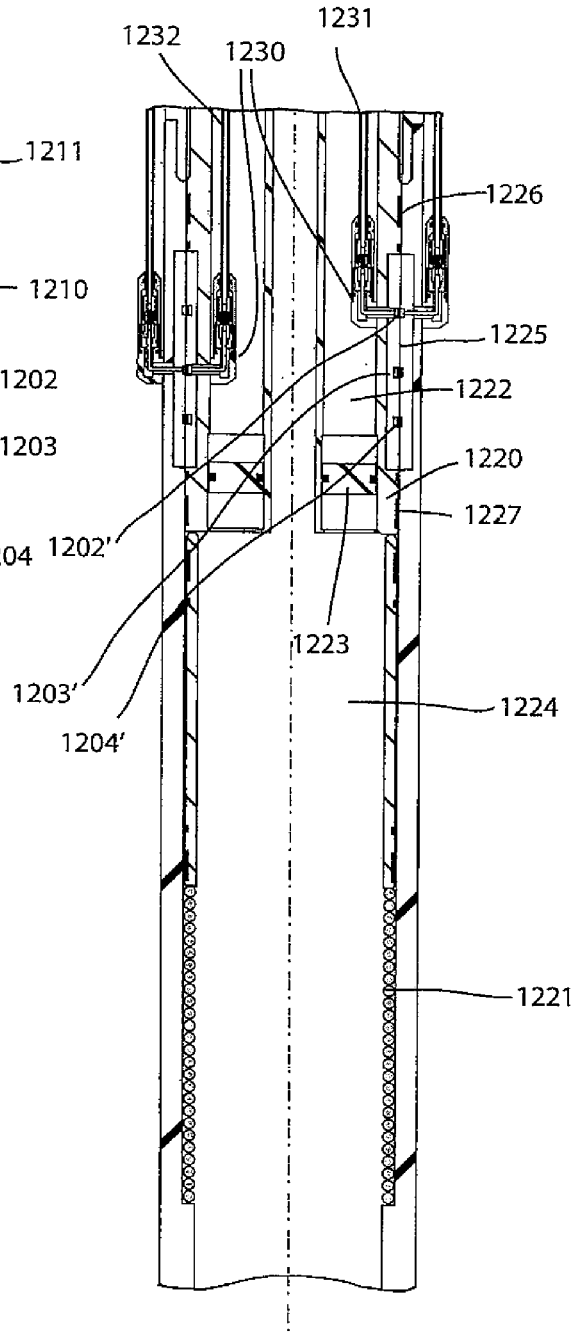
FIG. 31 shows a similar view to FIG. 30 with a tool deployed inside the tubing and fully engaged in the downhole wet connect assembly.

FIGS. 30 and 31 show a further embodiment of the invention. An annular body 1200, has a protective sleeve 1201 covering 3 electrical contact rings 1202, 1203, 1204. These rings are set in an insulation layer 1205, each ring being terminated to an electrical connector 1210, which in turn connects the cable to the surface 1211. At each end of the protective sleeve 1201 are seals 1212 and 1213. When the bottom face 1220 of the toolstring lowered on wireline contacts the sleeve 1201, it displaces the sleeve to a lower position which compresses a compression spring 1221 as shown in FIG. 31 so that the lowered toolstrings contacts 1202', 1203', 1204' respectively electrically engage the annular bodies electrical contacts 1202, 1203, 1204 in a full 360 degree contact.

Oil in a chamber 1222 is kept at equal pressure to the surrounding hydrostatic pressure in the well 1224 by a compensation piston 1223, this oil can also be in the area 1225 around the electrical contacts, seals 1226 and 1227 and also to prevent wellbore fluids from coming into contact with the electrical contacts 1202, 1202', 1203, 1203' 1204 and 1204', The electrical rings on the tool deployed are each terminated with a connector 1230 and the power cables 1231, 1232 are connected to the item requiring power in the tool deployed on wireline, be it a motor or some other device.

Figure 32:
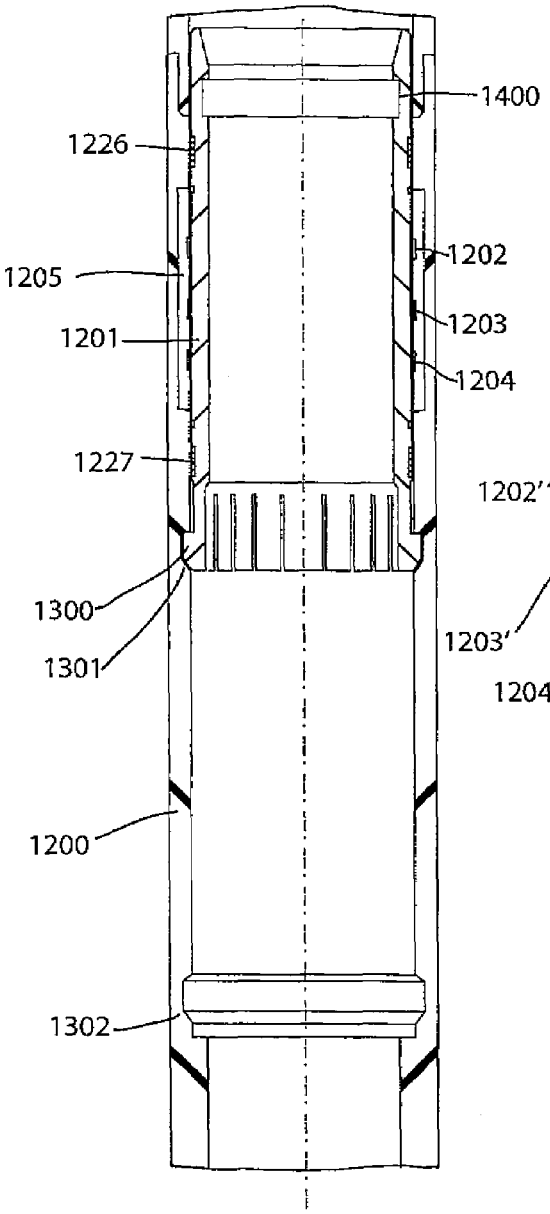
FIGS. 32 and 33 shows a further embodiment of the downhole wet connect assembly in use.
Figure 33:
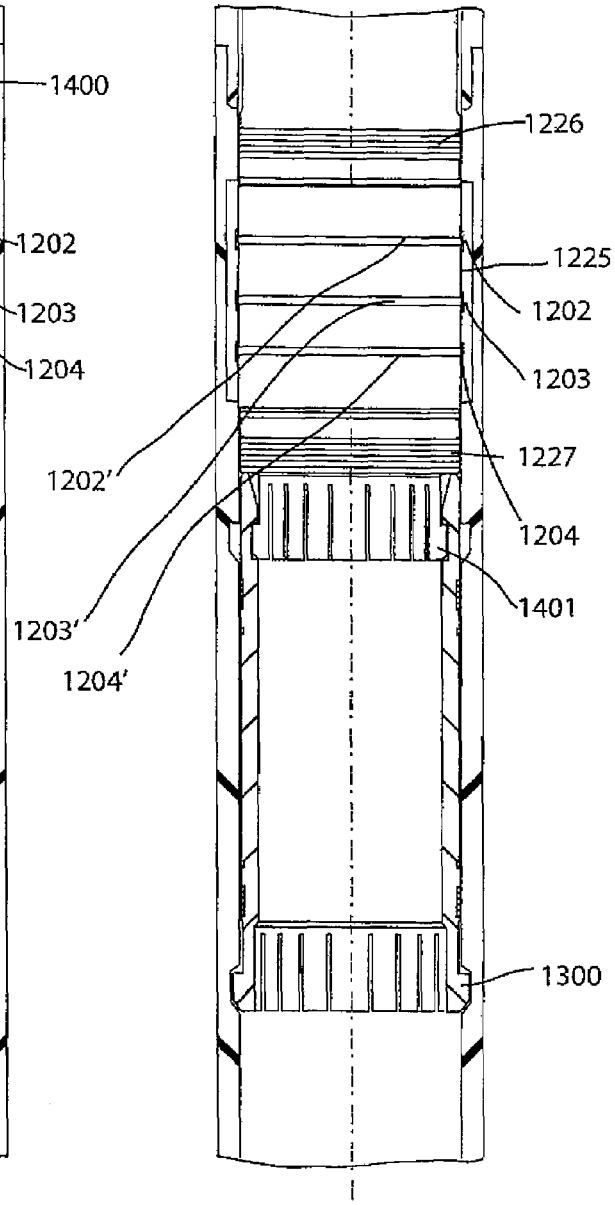

Referring to FIGS. 32 to 33, a further embodiment is the inclusion of collets 1300 with corresponding recesses 1301 and 1302 for parking the sleeve 1201 in its two extreme positions, and similarly collets 1400 and recess 1401 to latch onto the sleeve by the power device. The sleeve 1201 is for protection only and can be either recovered to surface or pushed to the bottom of the well if replacing it is desired.

A inner bore allows fluid to pass through the tool being deployed and a pressure compensation chamber keeps the differential pressure across the seals to virtually zero pressure.

This method of making an electrical connection downhole can be applied to many electrical and/or telemetry devices. For example, liquid-phase material is often present in underground gas reservoirs, either as condensation of hydrocarbon gas, or, particularly from coalbed gas wells, as water. The accumulation of liquid in the well imposes a back pressure which reduces the rate of gas production, and can kill a low pressure well.

Initially, the pressure of the well may be sufficient to carry the liquid and gas to be carried up the well together. However, the well pressure may not be sufficient for this, or it may be desired to remove liquid separately from the well for other reasons. Periods were the well must be dewatering typically last between six months and three years. One method of dewatering a well is to introduce a siphon pipe between the accumulated liquid and the surface of the well. However, the pressure of the well may be insufficient to carry liquid up the siphon quickly enough, and the accumulated liquid may build up, so reducing the gas production.

The wet connect methods described above can though be used in apparatus to provide a convenient an effective way of removing liquids from a well.

Where equivalent components appear in different embodiments, the same designating numeral will be used.

Figure 34:
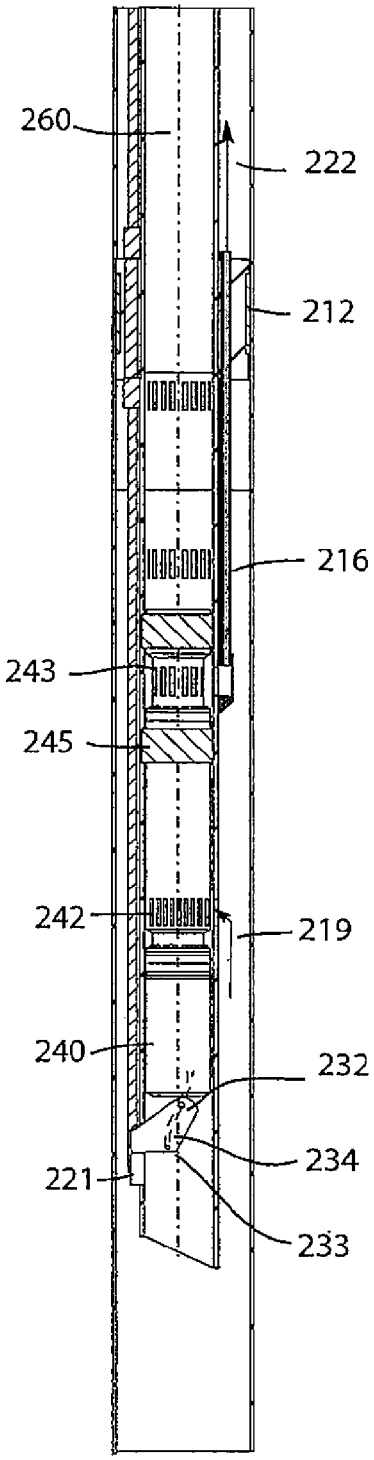
FIG. 34 shows a side view of a well, with a pump installed and used to empty water into the annular area above the packer, to enable gas to flow freely from the well

Referring to FIG. 34, a gas production tube 260 is disposed in a borehole 220 of a gas well. The gas production tube 260 is substantially concentric with the borehole 220 so that an annulus 222 exists between the casing of the borehole 220 and the gas production tube 260. The gas production tube 260 is sealed against the casing of the borehole 220 by a packer 212. The gas production tube 260 includes gas inlet apertures 214 which allow fluid communication between the inside of the gas production tube 260 and the annulus 222, the gas inlet apertures 214 being located a short distance beneath the packer 212. The lower end of the gas production tube 260 is open.

A pump discharge tube 216 runs along part of the gas production tube 260, ideally located on the gas production tube's outer surface. The upper end of the pump discharge tube 216 is located above the packer 212 and is open to the annulus 222. The pump discharge tube 216 extends past the gas inlet apertures 214, the pump discharge tube's lower end being sealed from the annulus 222 but communicating, via an aperture 217 in the gas production tube's wall, with the inner bore of the gas production tube 260.

An electrical power line 218 is also attached to the outside of the gas production tube 260, the line extending between the surface where it can be connected to a power supply, and a point typically beneath the lower end of the pump discharge tube 216. The lower end of the electrical power line 218 terminates with a electrical wet connector 221 that is accessible from the inner bore of the gas production tube 260.

The packer 212 is arranged such that the electrical power line 218 and the pump discharge tube 216 are accommodated without compromising the seal between the annulus 222 above the packer 212 and the annulus 222 below the packer 212.

The gas production tube 260 also includes an inlet port 219 allowing communication between the bore of the gas production tube 260 and the annulus 222. The inlet port 219 is situated between the pump discharge tube 216 and the electrical wet connector 221.

To install the motor and pump assembly is lowered through the gas production tube 260 using a slickline running tool.

The motor and pump assembly (comprising a motor 235 and pump 240) includes an electrical contact that engages with the electrical wet connector 221 through an aperture in the gas production tube 260. The connection mechanism illustrated shows a hinged plug 232 attached to the bottom of the motor and pump assembly, the hinged plug 232 including a protruding pin 233 that extends radially outwards towards the wall of the gas production tube 260. The motor and pump assembly is kept correctly oriented, by using for example an engaging profile between the motor and pump assembly. The gas production tube 260 also includes an inwardly protruding vane 234 having a surface set a shallow angle to the gas production tube's axis. When the motor and pump assembly near the desired position, the pin 233 of the hinged plug 232 engages with the inwardly protruding vane, causing the plug 232 to pivot (in an anti-clockwise direction when considered as illustrated in the figure), the gas production tubing in this region having a cut-out portion to accommodate the plug 232. An electrical contact (not visible) on the hinged plug 232 then engages with the electrical wet connector 221 mounted on the gas production tube 260. In addition to the engagement between the electrical wet connector 221 and the electrical contact on the hinged plug 232, further engagement means may be provided to support the weight of the motor and pump assembly.

When the motor and pump assembly has been located in its desired position at the lower end of the gas production tube 260, the slickline running tool is disengaged and retrieved.

The motor and pump assembly comprises a pump 240 connected above and driven by an electric motor 235 (which is supplied from the electrical power line 218 via the electrical wet connector 221 and the electrical contact on the hinged plug 232). When the motor and pump assembly is installed, the pump inlet port 219 is adjacent to the inlet 242 of the pump 240. The outlet 243 of the pump 240 is adjacent to the aperture 217 communicating with the lower end of the pump discharge tube 216. The pump's inlet 242 and outlet 243 are separated by a lower assembly seal 245. An upper assembly seal 244 separates the pump outlet from the bore of the gas production tube 260 above the motor and pump assembly.

Gas present in the borehole 220 enters the gas inlet apertures 214 of the gas production tube 260 and travels up the bore of the gas production tube 260 to the surface. When water or another liquid accumulates in the borehole 220 to the level of the pump inlet port 219, the electric pump 240 is operated to draw the water through the pump to exit through the pump's outlet 243 into the portion of the gas production tube 260 between the upper and lower assembly seals 244, 245. The water is then forced through the pump discharge pipe 216 into the borehole annulus 222, to be removed at the surface of the borehole. The gas produced and the water extracted from the borehole 220 are therefore conveniently transported up the borehole along separate paths.

The water found in coalbed mines often has includes a suspension of coal particles, and the presence of such particles can affect or damage the pump 240. If the pump 240 requires attention or replacement, the slickline running tool may be lowered down the gas production line, to engage with the motor and pump assembly. The motor and pump assembly may then be disengaged from the electrical and other connections, and winched to the surface. A repaired or replacement motor and pump assembly may then be deployed in the manner previously described.

Figure 35:
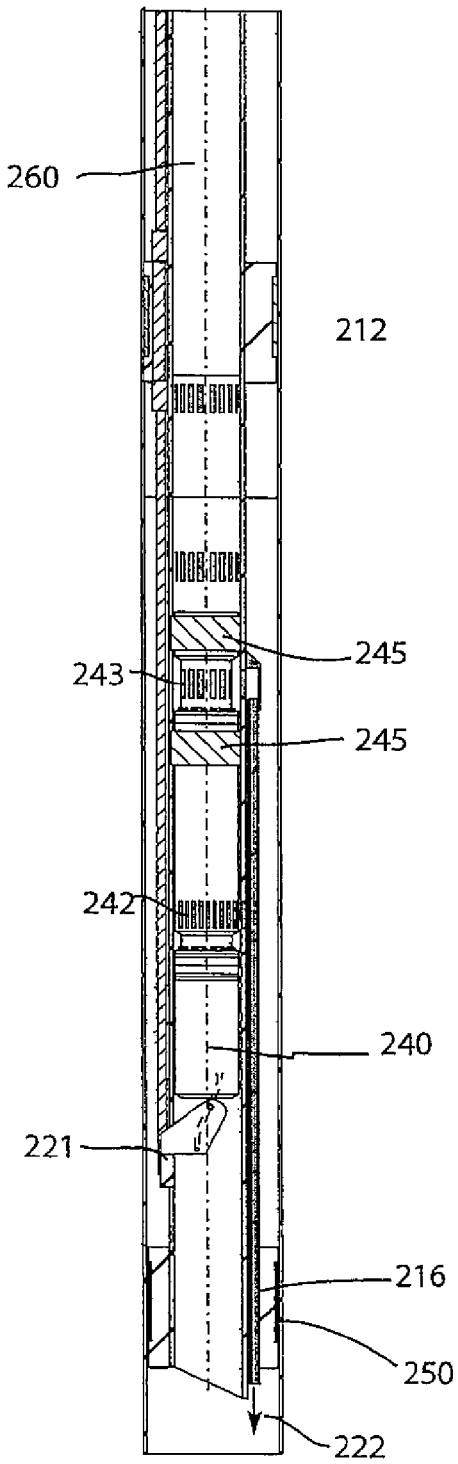
FIG. 35 shows a side view of a well, with a pump installed and used to empty water into a depleted zone below a packer in the lower sump region of the well, again, to enable gas to flow freely from the well

Referring to FIG. 35, in another embodiment the lowest portion of the borehole 220 is sealed by a sump packer 250. The motor and pump assembly are configured as previously described, being connected to a power supply via the electrical wet connector 221. The pump outlet 243 discharges into a 216 which extends through the sump packer 250. Gas in the borehole 220 above the sump packer 250 from the surrounding formation travels through the gas inlet apertures 214 into the gas production tube 260 as in the previous embodiment. As liquid accumulates in the borehole 220, the pump 240 may be activated, drawing liquid from the section of the borehole 220 in which the motor and pump assembly is situated, and discharging this liquid into the mine's sump beneath the sump packer 250. In this manner, liquid removed from the borehole, which is often contaminated with hydrocarbons, does not have to be treated or disposed of at the surface.

Another possible arrangement would be to lower the motor and pump assembly through the borehole until they come to a sump packer, so that the pump engages with the sump packer with the pump's outlet beneath the sump packer. The electric motor could be suspended, and electrically connected by a line to the assembly's electrical plug connection module, which engages mechanically with the gas production tube and electrically with the electrical wet connector in the manner previously described. The line connecting the electrical plug connection module and the motor and pump assembly must be sufficiently strong to carry the weight of the assembly.

In such an embodiment, the pump inlet is situated very close to the bottom of the portion of the borehole defined by the upper packer and sump packer. All but the smallest levels of accumulated liquid can therefore be injected into the zone beneath the sump packer.

It will be seen that for the embodiments where liquid is pumped beneath the sump packer, the annulus of the gas production tube is not required for transport of liquid. These embodiments may be effected less preferably without a gas production tube defining an annulus with the borehole. The installation of the gas production tube and packer to isolate the annulus, and the provision of the gas inlet apertures and pump discharge tube, together with a suitable sump packer, allows for adaptability of the dewatering process, different methods being adopted at different times or depending upon the characteristics of the well.

It will also be realised that other electrical types of connection between the electrical conductor and the motor could be employed with such a method of dewatering a gas well.

The invention claimed is:

1. A system for installing a powered device in a downhole tube, the system comprising:

a power line disposed along a production tube and terminating in a first power connector;

orientation means disposed in the vicinity of the first power connector;

a powered device including a second power connector, the powered device being lowered down the production tube and oriented by the orientation means so that the first power connector means and second power connector means engage to connect the powered device to the power line; and alignment means supporting the first power connector and moving the first power connector from a first unaligned position to a second aligned position as the first power connector descends toward it so that the first power connector and the second power connector engage to connect the powered device to the power line.

2. A system for installing a powered device in a downhole tube, the system comprising a power line disposed along a production tube and terminating in a first power connector, the powered device being down the production tube, the first power connector being supported by an alignment means that moves the first power connector from a first unaligned position to a second aligned position as the power connector descends toward it so that the first power connector means and second power connector means engage to connect the powered device to the power line.

3. The system according to claim 2 wherein the aligned position is closer to a center of a bore holding the powered device than the unaligned position.

4. The system according to claim 3 wherein a sleeve is provided with a cam surface shaped to orient the powered device.

5. The system according to claim 4 wherein the sleeve includes a keyway to move the first connection means toward the center of the bore.

6. A system for installing a powered device in a downhole tube, the system comprising a power line disposed along a production tube, terminating in a first power connector, the powered device including a second power connector, and means for radially aligning one or both of the connectors as the powered tool is lowered such that the connectors are aligned for engagement.

7. The system according to claim 6 wherein the second power connector is radially displaced when aligned by the alignment means.

8. A system for installing a powered device in a downhole tube, the system comprising:

a power line disposed along a production tube, terminating in a power connector or contact;

a powered device toolstring down the tube and having a corresponding power connector or contact;

means for aligning the two connectors or contacts as the connector or contact of the line approaches the connector or contact of the toolstring; and means for fitting together the two connectors or contacts such that they make electrical connection when the powered device toolstring is located adjacent to the power connector or contact of the production tube.

9. The system according to claim 8 wherein at least one of the power connectors or contacts is annular.

10. The system according to claim 8 wherein a protective element is adjacent to the power connector or contact of the production tube, the protective element being displaceable by the powered device toolstring to expose the power connector or contact of the production tube.

* * * * *

UNITED STATES PATENT AND TRADEMARK OFFICE

CERTIFICATE OF CORRECTION

PATENT NO. : 7,640,993 B2
APPLICATION NO. : 10/563855
DATED : January 5, 2010
INVENTOR(S) : Philip Head It is certified that error appears in the above-identified patent and that said Letters Patent is hereby corrected as shown below:

Title Page

1. Item 54 and Col. 1
   The title should show as:

-- SYSTEM FOR INSTALLING A POWERED DEVICE IN A WELL --

2. Item 73
   The name of the Assignee is:

-- ARTIFICIAL LIFT COMPANY LIMITED --

3. Item 73
   The address of the Assignee is:

-- LION WORKS, GAPTON HALL ROAD,
   GREAT YARMOUTH, NORFOLK (GB) --

Signed and Sealed this

Thirtieth Day of March, 2010

David J. Kappos

David J. Kappos
*Director of the United States Patent and Trademark Office*